US011993416B2

(12) United States Patent
Dabrowski et al.

(10) Patent No.: US 11,993,416 B2
(45) Date of Patent: May 28, 2024

(54) CONTAINER HAVING AN IMPROVED SIDE-LOAD DEFORMATION RESISTANCE

(71) Applicant: SOCIETE DES PRODUITS NESTLE S.A., Vevey (CH)

(72) Inventors: Nicolas Dabrowski, Vittel (FR); Lucas Gaino Albiero, Belmont-sur-Vair (FR); Johannes Zimmer, Lausanne (CH); Jason C. Billig, Thornwood, NY (US); Daniel T. Kim, Washington Township, NJ (US); Stuart M. Leslie, Larchmont, NY (US)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 17/284,120

(22) PCT Filed: Oct. 17, 2019

(86) PCT No.: PCT/EP2019/078160

§ 371 (c)(1),
(2) Date: Apr. 9, 2021

(87) PCT Pub. No.: WO2020/079122

PCT Pub. Date: Apr. 23, 2020

(65) Prior Publication Data

US 2021/0347516 A1 Nov. 11, 2021

(30) Foreign Application Priority Data

Oct. 19, 2018 (EP) ..... 18201600

(51) Int. Cl.
*B65D 1/02* (2006.01)

(52) U.S. Cl.
CPC .... *B65D 1/0223* (2013.01); *B65D 2501/0018* (2013.01); *B65D 2501/0081* (2013.01)

(58) Field of Classification Search
CPC ..... B65D 1/0223; B65D 2501/0018; B65D 2501/0081
(Continued)

(56) References Cited

U.S. PATENT DOCUMENTS

2008/0105645 A1 5/2008 Boukobza
2010/0072167 A1* 3/2010 Dickie ..... B65D 1/0292 215/382

(Continued)

FOREIGN PATENT DOCUMENTS

EP 1022223 7/2000
EP 1038785 9/2000

(Continued)

OTHER PUBLICATIONS

European Patent Office Communication for Application No. 19 786 591.8-1014, dated Feb. 6, 2023, 8 pages.

*Primary Examiner* — Robert J Hicks
*Assistant Examiner* — Sanjidul Islam
(74) *Attorney, Agent, or Firm* — K&L Gates LLP

(57) ABSTRACT

The invention relates to a container (1), preferably a bottle, which extends along a main axis (A) and comprising a wall forming a neck portion (2), a shoulder portion (3) connected to the neck portion (2), a body portion (4) connected to the shoulder portion (3), the body portion (4) comprising a grip portion (7), and a base portion (5) forming the bottom of the container (1) and connected to the body portion (4). The grip portion (7) comprises, over at least the majority of its dimension along the main axis (A), a plurality of spiral ribs (13) formed by the wall of the container (1) and spiralling in parallel around the main axis (A). The spiral ribs drastically increase side stability, compression and twisting deformation resistance of the container, while they have a non-technical and appealing appearance.

14 Claims, 6 Drawing Sheets

(58) Field of Classification Search
USPC ..... 215/379, 380, 382, 383, 384
See application file for complete search history.

(56) References Cited

U.S. PATENT DOCUMENTS

| | | | | |
|---|---|---|---|---|
| 2010/0155359 | A1* | 6/2010 | Simon | B65D 79/0084 220/675 |
| 2012/0219738 | A1 | 8/2012 | Boukobza | |
| 2017/0183138 | A1* | 6/2017 | Usami | B65D 1/0223 |
| 2018/0093789 | A1* | 4/2018 | Usami | B65D 1/42 |

FOREIGN PATENT DOCUMENTS

| | | | |
|---|---|---|---|
| JP | 540117 | | 5/1993 |
| JP | 2009057085 A | * | 3/2009 |
| JP | 2009057085 A | | 3/2009 |

* cited by examiner

CONTAINER HAVING AN IMPROVED SIDE-LOAD DEFORMATION RESISTANCE

CROSS REFERENCE TO RELATED APPLICATIONS

The present application is a National Stage of International Application No. PCT/EP2019/078160, filed on Oct. 17, 2019, which claims priority to European Patent Application No. 18201600.6, filed on Oct. 19, 2018, the entire contents of which are being incorporated herein by reference.

FIELD OF THE INVENTION

The present invention relates to containers.

More specifically, the present disclosure relates to containers having improved stability as well as an improved side-load deformation resistance.

A container according to the invention may in particular be capable of containing fluid. Such a container may for example be a bottle for holding water or another liquid beverage.

BACKGROUND

Currently, the market comprises many different shapes and sizes of containers capable of holding fluids. The shape and size of fluid containers can depend, among other things, on the amount of fluid to be held, the type of fluid to be held, consumer demands and desired aesthetics.

For example, thermoplastic containers for beverages are known in the art. These containers are generally made of a semi-crystalline polyethylene terephthalate (PET) for good transparency. Such plastic containers are typically blow-molded using an injected preform.

The quantity of raw plastic material used to produce a container is the main factor in the production cost of such a container. There is a high interest, in particular in the bottled water industry, in reducing the quantity of material for forming the container to reduce its cost.

For this reason, lightweight containers have been proposed. Such lightweight containers contain less plastic and have a reduced wall thickness. For example, at least in the middle-height region of the container body the wall thickness of a lightweight container may be less than or equal to 100 μm. These lightweight containers are, therefore, manufactured with a substantially lower amount of plastic material compared to containers of similar content volume made using traditional processes. Lightweight containers are cheaper to produce and have a lower environmental impact. The weight of plastic bottles on the market is constantly decreasing due to optimized geometry and reduced processing tolerances.

However, the weight reduction results in challenges as the lightweight container should be able to withstand different environmental factors encountered during manufacturing, shipping and retail shelf stocking or storage, and use (e.g. consumption of its content). In particular, a container must be able to withstand mechanical stresses which comprise horizontal forces applied during grabbing (for consumption of the content of the container), or due to shrinkage forces within packs of containers.

To enhance their stability, in particular their lateral stability, namely their resistance to permanent local deformation under horizontal stresses, the containers are generally provided with stiffening elements such as horizontal ribs formed in the wall or walls of the container.

On the other hand, in a product range often called "premium-packaging" comprising high-end containers, the presence of ribs or other elements obviously designed for stiffening the container is often frowned upon by the consumer. There is thus a tendency, in premium-packaging, to remove conventional stiffening elements, such as horizontal ribs, as much as possible in order to differentiate the container design from conventional technical designs and to provide it with an appealing appearance.

However, the horizontal ribs provide packaging stability throughout the product life cycle. In order to ensure sufficient stability for the packaging using those premium designs e.g. with plain and/or flat surfaces without horizontal ribs, a large quantity of material is necessary. This results in a costlier container, with improvable characteristics in terms of environmental compliance.

There is thus a high interest, especially in the bottle water industry, in providing a container made from as little material as possible and which is differentiated from conventional bottle designs, and which especially looks like having a "non-technical" appearance while providing sufficient stability for transport and use.

Known solutions to address this problem are based on modified horizontal ribs. It is for example known to provide a bottle with substantially horizontal ribs having a varying depth along the perimeter of the bottle.

Those ribs can also have a sinusoidal trajectory resulting in a wave-like shape around the perimeter of the bottle.

Such ribs enable some differentiation compared to purely horizontal ribs and they can also bring additional advantages such as increased stability against bending. This is important during filling and labelling as well as to a certain extent during pallet transport. However, those known solutions are based on horizontal ribs and a greater differentiation is desirable.

SUMMARY OF THE INVENTION

The invention aims at providing a container such as a plastic bottle having a high-end appearance while limiting the weight of material used to form the container compared to a container having plain and flat wall surfaces, and providing at the same time sufficient side stability and side resistance.

The invention relates to a container, preferably a bottle, which extends along a main axis and comprising a wall forming a neck portion, a shoulder portion connected to the neck portion, a body portion connected to the shoulder portion, the body portion comprising a grip portion, and a base portion forming the bottom of the container and connected to the body portion. The grip portion comprises, over at least the majority of its dimension along the main axis, a plurality of spiral ribs formed by the wall of the container and spiralling in parallel around the main axis.

A container according to the invention has thus a wall provided with geometrical features forming spiral ribs. Compared to the prior art, the spiral ribs are no longer the result of a revolution of a rib profile around the bottle axis but rather a sweeping of a specific sectional profile along a well-defined trajectory. Spiral ribs provide the container with a different and distinctive appearance, and, while they have an essential stiffening technical function, they are not seen by the user as directly linked with this function.

The spiral ribs drastically increase side stability, compression and twisting deformation resistance of the container.

They are mainly formed at the location of the grip portion of the container, i.e. where a user can grab the container. The spiral ribs stiffen the container in this area where mechanical stresses are applied when the container is used.

Each spiral rib can advantageously form on an external surface of the wall a concavity in combination with a spiral tapered edge. This optimized cross section of the spiral ribs drastically increases side stability, compression and twisting deformation resistance of the container.

At the bottom of the concavity, the wall of the container presents an inflexion point.

The width of the spiral rib is measured between the inflexion point and the tapered edge.

The spiral rib can have a substantially constant width over a majority of the length of the spiral rib. The width may for example be comprised between 3 mm and 10 mm, for example between 5 mm and 8 mm.

Each spiral rib can further comprise a strip, adjacent to the tapered edge, said strip having a constant width and being defined in a surface of revolution having the main axis as revolution axis. The width of the strip may for example be comprised between 5 mm and 15 mm.

The container may comprise between three and seven, for example five, spiral ribs. The spiral ribs can be evenly distributed on the grip portion.

Each spiral rib can form an angle comprised between 70° and 180° around the container, for example an angle comprised between 90° and 150°, and more particularly between 120° and 130°, for example around 123°.

The grip portion can be substantially cylindrical and the spiral ribs can be substantially helical.

Hence the pitch of the spiral rib may vary along it height.

For example, each spiral rib has a constant or variable pitch which is superior throughout the spiral rib to the dimension of the grip portion along the main axis.

Alternatively, each spiral rib having two ends, each spiral rib can have a variable pitch which changes along the spiral rib by decreasing from one end of the spiral rib to substantially the middle of said spiral rib and then by increasing to the other end of the spiral rib.

The grip portion can have a non-circular cross section perpendicular to the main axis (A) at least substantially in its middle. for example, this non-circular cross section can be based on an equilateral triangle having rounded sides and corners.

The grip portion can have, substantially in the middle of its dimension along the main axis, a shrunk cross section: the area of the shrunk cross section can be comprised between 35 and 95% of the area of the cross section of the container at the connection between the shoulder portion and the body portion.

The spiral ribs can have a maximum depth comprised between 1 and 3.5 mm, for example between 1.5 and 3 mm. The spiral ribs can have a constant depth over at least a major part of their length, said constant depth being the maximum depth.

The body portion can further comprise, between the shoulder portion and the grip portion, a label portion adapted to receive a flexible label, the label portion being plain or comprising annular ribs.

The container can comprise at least one annular groove between the shoulder portion and the body portion, and/or between the body portion and the bottom portion.

The container can have a total internal volume comprised between 15 cl and 150 cl, for example 20 cl, 33 cl, 50 cl, 60 cl or 100 cl.

BRIEF DESCRIPTION OF THE DRAWINGS

Other particularities and advantages of the invention will also emerge from the following description. It will be appreciated that the invention as claimed is not intended to be limited in any way by these examples.

In the accompanying drawings, given by way of non-limiting examples.

DETAILED DESCRIPTION OF EMBODIMENTS

Figure 1:
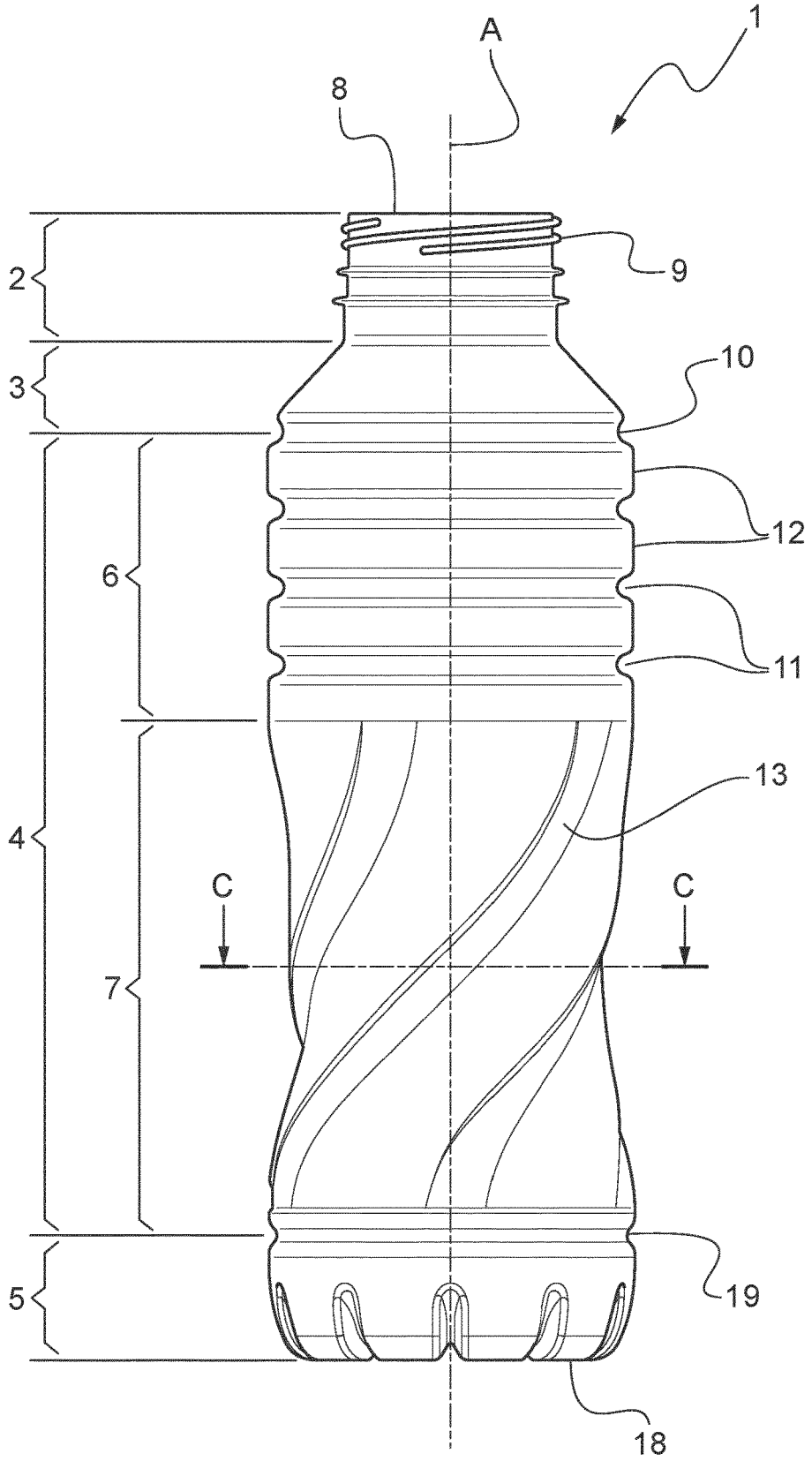
FIG. 1 is a front plan view of a container in an embodiment of the present invention.

In the following detailed description, reference is made to the accompanying drawings, which form a part hereof. In the drawings, similar symbols and references typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

As used in this specification, the words "comprises", "comprising", and similar words, are not to be interpreted in an exclusive or exhaustive sense. In other words, they are intended to mean including, but not limited to.

Any reference to prior art documents in this specification is not to be considered as an admission that such prior art is widely known or forms part of the common general knowledge in the field.

In particular, disclosed herein are articles, including preforms, bottles and containers, which utilize an optimized quantity of plastic in their construction while maintaining the ease of processing and excellent structural properties associated with current commercial designs.

The present invention will be described in connection with a container, for example, a bottle.

The present disclosure relates to stable, load-bearing containers for providing consumable products and, in particular, fluids. The containers are constructed and arranged to be stable and load-bearing to provide a container having not only improved structural features, but also desirable aesthetics.

As previously described, a major challenge in the bottling industry is the reduction of the quantity of thermoplastics used to produce a container. However, container made with a small amount of material may have problems transmitting vertical loads efficiently and resisting side loads.

Specifically, during packaging, distribution and retail stocking, containers or bottles can be exposed to large amounts of top-loading and can buckle at any existing points of weakness on the container. Additionally, due to the generally cylindrical shape of known containers, the sides of the container body are very flexible and a risk exists that once the container is open, the contents will splash out of the container when grabbed or squeezed by the consumer. Shrinkage forces can also exist within packs of containers, potentially causing permanent deformations of the containers if they are not able to sustain such forces.

During packaging, distribution, and retail stocking, containers can be exposed to widely varying temperature and pressure changes, as well as external forces that jostle and shake the container.

Figure 2:
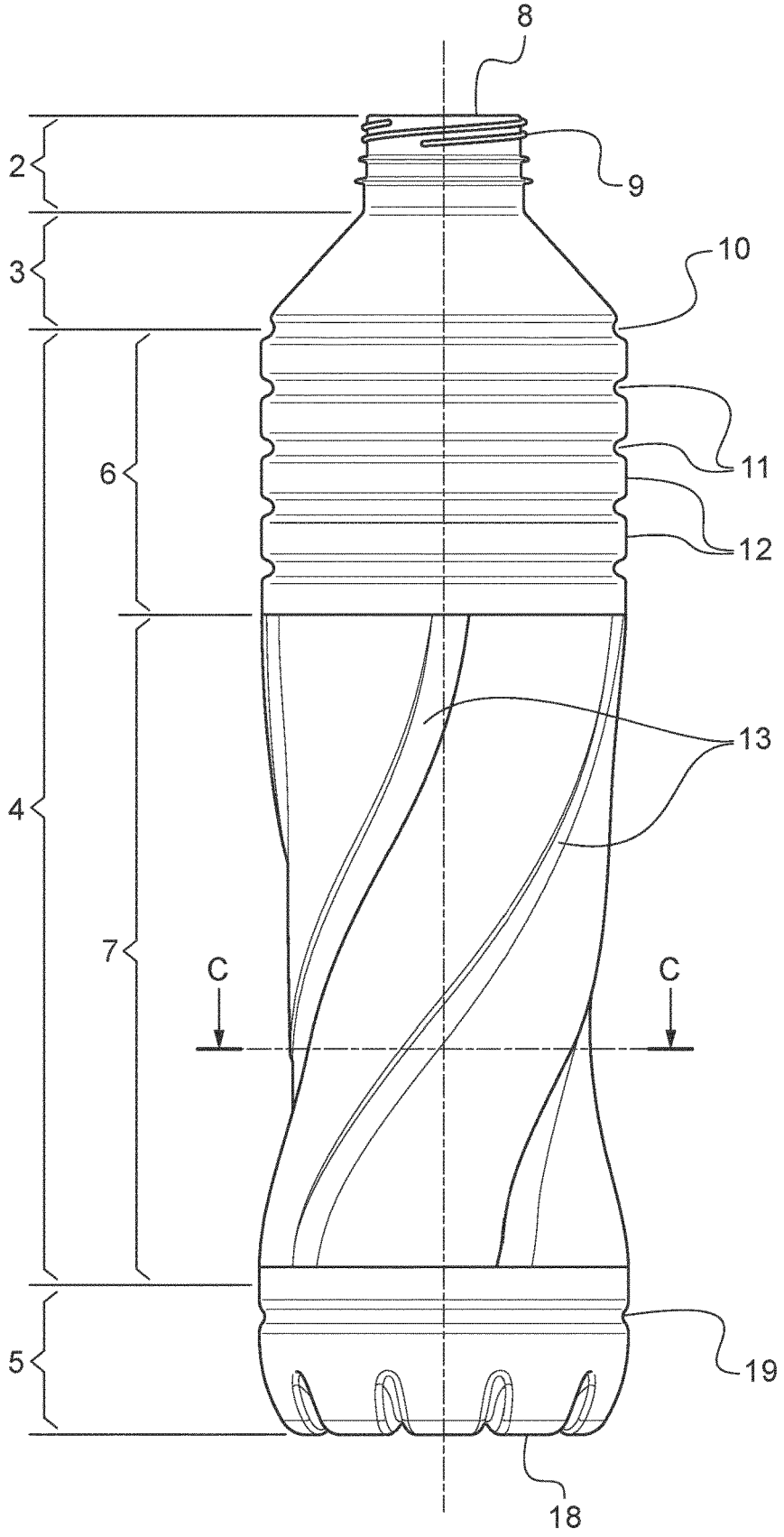
FIG. 2 is a front plan view of a container in another embodiment of the present invention.

FIG. 1 illustrates a front view of a container 1 according to an embodiment of the invention. FIG. 2 illustrates, according to a similar view, a container according to an embodiment of the invention in which the volume of the container is bigger than the volume of the container of FIG. 1.

In the embodiment of FIG. 1, the container 1 is configured to contain up to about 200 mL of a liquid. In the embodiment of FIG. 2, the container 1 is configured to contain up to 600 mL of a liquid.

Containers 1 according to the invention may hold any suitable volume of a liquid such as, for example, from about 150 to 2000 mL including 200 mL, 250 mL, 300 mL, 330 mL, 450 mL, 500 mL, 600 mL, 750 mL, 800 mL, 900 mL, 1000 mL, 1500 mL, 2000 mL, and the like (in particular an intermediate volume).

The container 1 is formed by a wall, which defines an internal volume. The container 1 extends along a main axis A. The container can for example have a substantially cylindrical shape. The diameter for the container can be for example comprised between 40 mm and 120 mm.

The container 1 comprises a neck portion 2, a shoulder portion 3, a body portion 4 and a base portion 5. The body portion 4 is connected to the base portion 5 and the shoulder portion 3.

In the represented embodiment, the body portion 4 comprises a label portion 6 (which is optional in the invention) and a grip portion 7.

The neck portion 2 comprises the mouth 8 of the container, i.e. the aperture from which liquid can be dispensed from the container 1, or by which the container can be filled.

The mouth 8 may be of any size and shape known in the art so long as liquid may be introduced into container 1 and may be poured or otherwise removed from container. In an embodiment, the mouth 8 may be substantially circular in shape and have a diameter ranging from about 10 mm to about 50 mm, or about 15 mm, 20 mm, 25 mm, 30 mm, 35 mm, 40 mm, 45 mm, or the like. In an embodiment, the mouth 8 has a diameter of about 32.5 mm.

The neck portion 2 may also have any size and shape known in the art so long as liquid may be introduced into container 1 and may be poured or otherwise removed from container 1. In an embodiment, neck portion 2 is substantially cylindrical in shape having a diameter that corresponds to a diameter of mouth 8. The man skilled in the art will appreciate that the shape and size of neck portion 2 are not limited to the shape and size of the mouth 8.

The neck portion 2 may have a height (measured along the main axis A from the mouth 8 to the shoulder portion 3) from about 5 mm to about 45 mm, for example about 10 mm, 15 mm, 20 mm, 25 mm, 30 mm, 35 mm, 40 mm, or the like. In an embodiment, the neck portion 2 has a height of about 25 mm.

The container 1 can further include a fluid-tight cap or a peelable membrane (not represented) attached to the neck portion 2. The cap can be any type of cap known in the art for use with containers similar to those described herein. The cap may be manufactured from the same or from a different type of polymer material as container 1, and may be attached to container 1 by re-closeable threads, or may be snap-fit, friction-fit, etc. Accordingly, in an embodiment, the cap includes internal threads (not shown) that are constructed and arranged to mate with external threads 9 of neck portion 2.

The shoulder portion 3 of the container 1 extends from a bottom of the neck portion 2, i.e. the end of the neck portion opposite to the mouth 8, downward to a top of the body portion 4, which in the represented embodiment is also the top of the label portion 6.

The shoulder portion 3 comprises a shape that is substantially a conical frustum. As used herein, a "conical frustum" means that shoulder portion 2 has a shape that closely resembles a cone having a top portion (e.g., the apex) of the cone lopped off. The shoulder portion 3 has a lopped off apex since the shoulder portion 3 tapers into the neck portion 2.

The shoulder angle formed between the wall surface of the shoulder portion 3 and the main axis A is an important feature to increase the top-load deformation resistance (i.e., vertical resistance to deformation, in the direction of the main axis A) of the container. The shoulder angle may for example be comprised between 30° and 60°, for example about 43°.

The shoulder portion 3 may by connected to the body portion (e.g. at the top of the label portion 6) via a first connecting portion comprising or formed by a first transitional annular groove 10. In the represented embodiment, the first transitional annular groove 10 has a curved shape, defined by a constant width and a constant depth along the perimeter of the container.

In the represented embodiment, the body portion 4 comprises a label portion 6 connected to the shoulder portion 3. The label portion is configured to receive a flexible label, for example fixed by an adhesive product. The label portion may thus have a plain surface where the flexible label can be fixed. In the represented embodiment, the surface of the label portion comprises a plurality of annular ribs 11. The annular ribs 11 have a constant width and depth (notably a constant width measured between two flat surfaces 12 of the label portion 6, and a constant depth measured from those flat surfaces 12).

In the represented embodiment, the annular ribs have constant section. The section of the represented ribs is substantially semi-circular. The semi-circular section is however smoothly linked to the flat surfaces 12. Other sections can be used, for example substantially trapezoidal or triangular. The annular ribs 11 provide an increase of the side-load deformation resistance (i.e., lateral deformation resistance) and of the top-load deformation resistance (i.e., vertical deformation resistance) of the container.

The body portion 4 comprises a grip portion 7. As used herein, "grip portion" may be used interchangeably with "prehension portion" or "grabbing portion". As used herein, "prehension", "grabbing" or "handling" means the act of taking hold, seizing or grasping. Accordingly, a prehension portion, or grip portion, of the container may be a portion of the container intended for seizing or grasping by the consumer during handling of the container.

The grip portion can, for example, have a height (measured along the main axis A) comprised between 80 mm and 200 mm.

The grip portion 7 can be provided with a shrunk, constricted, cross section, compared to the cross section at the connection between the shoulder portion 3 and the body portion 4. The wall of container may for example be recessed inwards by from 3 to 6 mm, substantially in the middle (along the main axis A) of the grip portion 7.

If the container has a substantially circular cross section, this can mean a reduction of the diameter of the container, at the location of the grip portion, from 6 to 12 mm.

For a container having a cross section of any shape, and/or not the same cross section shape at the connection between the shoulder portion 3 and the body portion 4 and at the middle of the grip portion, the surface of the shrunk cross section may be for example comprised between 35 and 95% of the surface of the cross section of the container at the connection between the shoulder portion 3 and the body portion 4.

The reduction of section in the grip portion can be defined by a circular and inwardly recess formed according to an arc of a circle defined at the location of the middle of the grip portion.

A shrunk cross section in the grip portion facilitates grabbing of the container and can also increase the deformation resistance and stability of the container.

According to the invention, the mechanical properties of the grip portion and consequently of the container are improved by spiral ribs 13 formed in the wall of the container.

In the proposed embodiments, the spiral ribs 13 are formed over at least a majority of the dimension of the grip portion along the main axis, i.e. over the spiral ribs extends over the majority or over the full height of the grip portion.

The spiral ribs formed in the container wall are defined by various geometrical features. Their trajectory around the axis A can in particular be defined by a pitch, i.e. the distance along the main axis A over which the spiral performs one turn around said axis A. The pitch of each spiral rib may be constant (in this case each spiral rib is helical), or variable.

In the case of a variable pitch, the variable pitch can change along the spiral rib by decreasing from one end of the spiral rib to substantially the middle of said spiral rib and then by increasing to the other end of the spiral rib. The variable pitch is for example maximum (for example infinite) at both ends of the spiral rib and progressively reaches its minimum value in the middle of the rib in the vertical direction (direction defined by the main axis A). An infinite pitch means that a spiral rib can start at its ends parallel to the longitudinal axis A. A variable pitch can provide the spiral rib with an undulating form in the vertical direction (defined by the longitudinal axis A).

Each spiral rib 13 is configured to form less than one turn around the grip portion of the container. For example, each spiral rib can be configured to form about half a turn around the grip portion. Advantageously, each spiral rib forms an angle comprised between 70° and 180° (a half turn) around the container, for example an angle comprised between 90° (a quarter turn) and 150°, and more particularly between 120° and 130°, for example around 123°. For a spiral rib extending over the whole height of the grip portion, this means that the pitch of the spiral rib is greater than the height of the grip portion, provided that this pitch is constant. For a variable pitch, the medium value of the variable pitch is greater than said height of the grip portion.

It can be provided that the pitch is greater than the height of the grip portion at every point of the spiral rib.

Another way to characterise the trajectory of the spiral rib is the rib angle formed, for example in the middle of the gripping portion 7, between the rib and a line parallel to the main axis A of the container. The rib angle can, for example, be comprised between 15° and 60°.

For instance, one end of the spiral rib is situated near the shoulder portion or label portion of the container 1 and the other end is situated near the bottom portion 5 of the container 1.

The container comprises a plurality of spiral ribs 13. For example, three, four, five, six or seven spiral ribs 13. The spiral ribs 13 spiral in parallel. This means that the angle formed between two given spiral ribs 13 and the main axis A remains constant for any cross section of the container (where spiral ribs 13 are present). If the container is substantially cylindrical, having a constant circular cross section, the distance (shortest distance) between the ribs measured at the surface of the wall of the container is constant.

The spiral ribs 13 are advantageously evenly distributed on the grip portion. The angle $\alpha$ between two successive ribs and the main axis 1 is thus the same. For example, if the container comprises three spiral ribs 13, the angle $\alpha$ has a value of 120°. If the container comprises four spiral ribs 13, the angle $\alpha$ has a value of 90°. If the container comprises five spiral ribs 13, the angle $\alpha$ has a value of 72°. If the container comprises n ribs, the angle $\alpha$ has a value of 360/n°.

Figure 3:
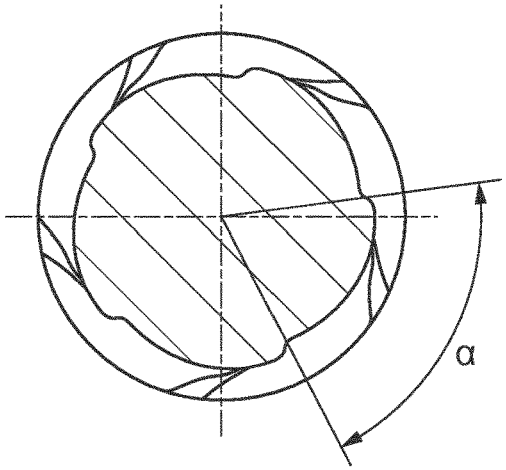
FIG. 3 is a cross-sectional view of the container of FIG. 2.

FIG. 3 represents the cross section of container 1 of FIG. 2 according to plan C-C which is perpendicular to the main axis A, as shown in FIGS. 1 and 2.

Figure 4:
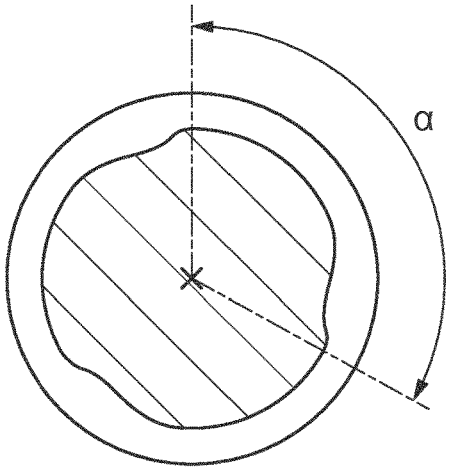
FIG. 4 is a cross-sectional view of a container according to an embodiment of the invention wherein the container comprises three spiral ribs.

The angle $\alpha$ is represented in FIG. 3 and FIG. 4. In the embodiment of FIG. 3, the container has five spiral ribs, evenly distributed at the periphery of a substantially cylindrical container. FIG. 4 represents, in a similar cross-sectional view as FIG. 3, an example embodiment of a container having three spiral ribs (which are, in the example of FIG. 4, evenly distributed).

Figure 5:
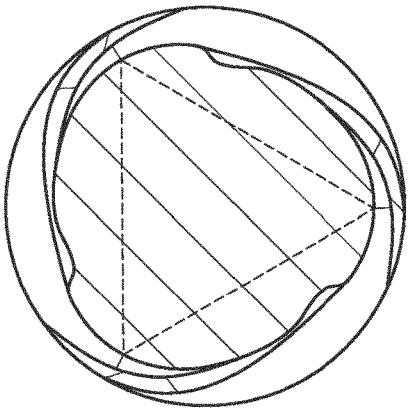
FIG. 5 is a cross-sectional view of a container according to an embodiment of the invention wherein the container comprises a non-circular cross-section.

FIG. 5 is a similar cross sectional view as FIG. 3 and FIG. 4, which represents an embodiment in which the grip portion 7 of the container has a non-circular cross section. According to various embodiments, the whole container can have a non-circular cross-section, or only the gripping part can have a non-circular cross section. In the embodiment of FIG. 5, the top of the bottom portion has a circular cross section while the section of the grip portion smoothly changes into a rounded form based on an equilateral triangle at section plane C-C. More particularly, the cross section C-C of the embodiment of FIG. 5 is based on an equilateral triangle (shown in dashed lines in FIG. 5) having rounded sides and corners.

Such non-circular cross section (based on a triangle or on another suitable shape) can help to increase the deformation resistance of the container, especially side-load deformation resistance.

Figure 6:
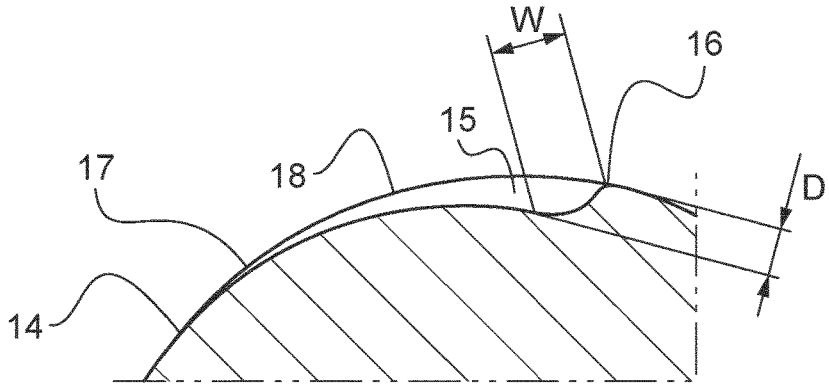
FIG. 6 is a detailed view of a spiral rib, seen in cross section, of the embodiment of FIGS. 2 and 3.

An optimized section of the spiral ribs is important to obtain a great increase of deformation resistance of the container 1. By section of the spiral ribs, it is meant the shape of the spiral rib (i.e. the shape of the container wall where a rib is formed) according to a section plane perpendicular to the main axis A. A detailed view of the section of a spiral rib at cross section C-C according to the embodiment of FIGS. 2 and 3 is represented in FIG. 6.

In this embodiment, the spiral rib forms on external surface 14 of the wall of the container a concavity 15 and a spiral tapered edge 16.

The concavity 15 is a recess formed in the wall of the container. On a first flank 17 of the spiral rib, the wall is smoothly deformed inwardly (in the direction of the inside of the container). In the represented embodiment where the cross-section of the container is substantially circular, the wall of the container smoothly leaves the circular trajectory 18 to form the concavity 15.

On a second flank of the rib, the wall abruptly joins the circular trajectory 18 and a tapered edge 16 is formed. To form the tapered edge, the wall of the container may be provided with small curvature radius at the second flank of the rib, for example comprised between 0 and 2 mm, for example between 0.3 and 1.7 mm.

Such a tapered edge provides additional stability.

The spiral ribs are also defined by their depth and width. Both depth and width of the spiral ribs can be constant over at least a major part of the spiral rib or variable along the spiral rib.

The depth D of the rib is defined as the distance between innermost portion of the rib ("bottom") and an adjacent portion of an outer wall of the container 1.

The maximum depth of the spiral ribs 13 can comprised between 1 and 3.5 mm, and more particularly between 1.5 and 3 mm.

The depth D of the spiral ribs can in particular be variable all along the spiral rib, to reach the maximum depth substantially in the middle of the length of the spiral rib (the length of the spiral rib being measured along the rib). In other embodiments, the depth D of the spiral ribs is constant along most of the length of the rib. The depth D can in particular be constant all along the spiral rib, except at each end of the rib where it smoothly joins the general shape of the container.

The width W of the spiral rib can be defined by the distance between an inflexion point situated at the bottom of the concavity 15 and the tapered edge 16.

The width of the spiral rib can be constant over a major part of the rib, in other words over a majority of the length of the rib. The width W of the spiral rib can in particular be comprised between 3 mm and 10 mm. The width W can in particular be comprised between 5 mm and 8 mm.

The container 1 further comprises a base portion 5, which forms a bottom of the container. The base portion 5 of container 1 comprises, in the represented embodiment, a rest base 18, which may be of any suitable design, including those known in the art and as illustrated.

The connection between the body portion 4 and the base portion 5 of the present container includes a base transitional annular groove 19, which is an opened trapezoidal groove that helps to ensure good rigidifying structure of the container.

Figure 7:
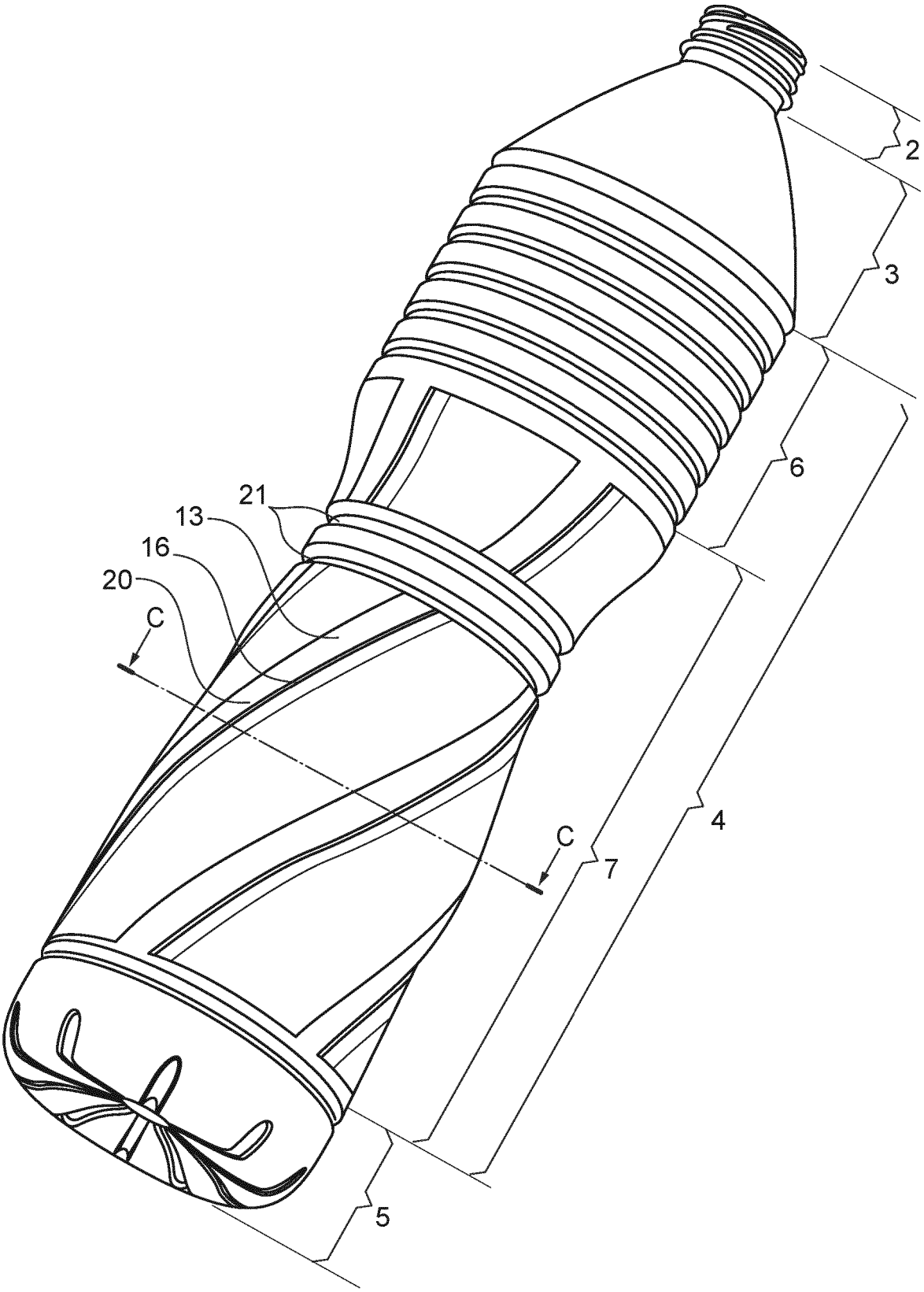
FIG. 7 is a three dimensional view of a container according to an embodiment of the invention.
Figure 8:
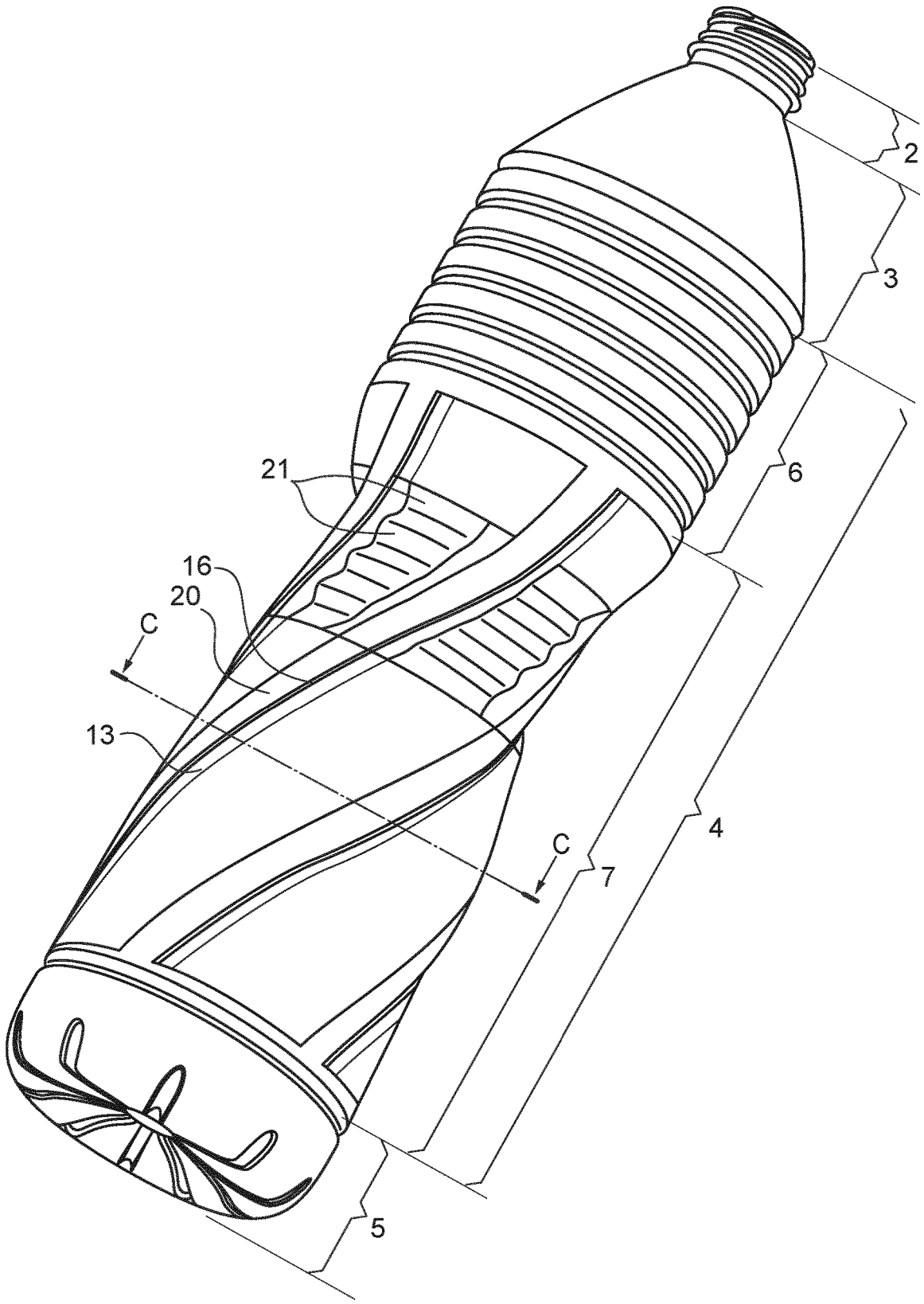
FIG. 8 is a three dimensional view of a container according to another embodiment of the invention.

FIG. 7 and FIG. 8 are three dimensional views of a container according to an embodiment of the invention. These embodiments provide a particular design of spiral ribs, which enhances the mechanical properties of the container (side, twisting and top-load deformation resistance).

This spiral rib design is particularly advantageous for high volume containers, namely above one liter, such as 1.5 L bottles.

More particularly, the spiral ribs 13 provided in these embodiments are based on a similar design to those of the embodiments of FIGS. 1 to 6, as each spiral rib 12 forms on external surface 14 of the wall of the container, a concavity 15 and a spiral tapered edge 16. The description made above of the spiral ribs of FIGS. 1 to 6 applies to the spiral ribs of FIG. 7, and 8.

Figure 9:
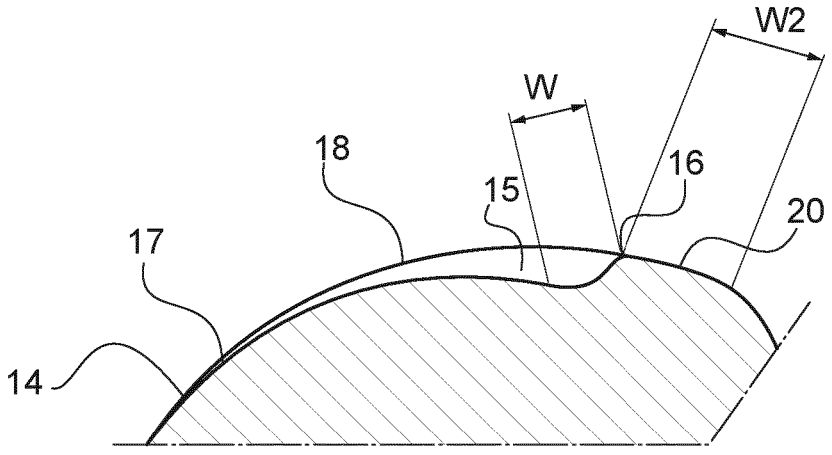
FIG. 9 is a detailed view of a spiral rib, seen in cross-section, of the embodiment of FIG. 7 or FIG. 8.

However, as shown in FIG. 9 which is a detailed view in cross-section similar to FIG. 6, in these embodiments each spiral rib further comprises a strip 20, adjacent to the tapered edge 16. The strip 20 has a constant width W2. The strip 20 which extends next to the tapered edge 16 is a part of a surface of revolution having the main axis (A) as revolution axis. As shown in FIG. 9, the strip 20 thus extends from the tapered edge 16 over the circular trajectory 18.

The containers of FIGS. 7 and 8 are bottles the grip portion of which has a shrunk part to help a user to conveniently grip and hold said container. The shrunk part is provided with circular ribs 21, which highly increases the side-load deformation resistance of the container in this area.

According to the embodiment of FIG. 7, the spiral ribs 13 are interrupted over the circular ribs 21, i.e. they do not extend over said circular ribs 21. Each spiral rib extends however on each side of the ribbed shrunk part: each spiral rib 13 is stopped as it reaches a circular rib 21, but is resumed on the other sides of the ribbed shrunk part of the container.

In this embodiment, the container can be very easily gripped, high side deformation resistance is provided by the circular ribs where the bottle is intended to be held by the user, while top load deformation resistance and side deformation resistance is enhanced over the rest of the grip portion 7 by adapted spiral ribs 13.

According to the embodiment of FIG. 8, the strip 20 of each spiral rib 13 is uninterrupted by the shrunk part comprising circular ribs 21. In other words, the strip 20 is continued over the shrunk part of the container and crosses the circular ribs 21. The strips can deflect towards the main axis A at the level of the ribbed shrunk part of the container.

In this embodiment, the advantages in terms of mechanical strength of the spiral ribs 13 with strips 20 and of the circular ribs 21 in a shrunk part are combined. High side-load deformation resistance is provided by the circular ribs, while top-load deformation resistance and side deformation resistance is greatly enhanced over the entire grip portion 7 by adapted spiral ribs 13 with strips 20.

Suitable materials for manufacturing containers of the present disclosure can include, for example, polymeric materials. Specifically, materials for manufacturing bottles of the present disclosure can include, but are not limited to, polyethylene ("PE"), low density polyethylene ("LDPE"), high density polyethylene ("HDPE"), polypropylene ("PP"), polyethylene furanoate ("PEF") or polyethylene terephthalate ("PET").

Further, the containers of the present disclosure can be manufactured using any suitable manufacturing process such as, for example, conventional extrusion blow molding, stretch blow molding, injection stretch blow molding, and the like.

Containers of the present disclosure may be configured to hold any type of liquid therein. In an embodiment, the containers are configured to hold a consumable liquid such as, for example, water, an energy drink, a carbonated drink, tea, infusion, coffee, milk, juice, etc.

A container according to the invention is thus provided with good deformation resistance and stability, while it may be formed by a thin wall, having for example a thickness of about 80 to 300 micrometers. The spiral ribs provided on a container according to the invention increase the side-load deformation resistance of the container in particular in the grip portion. The spiral ribs have however an appealing design, and, in any case, are not seen by the user as a purely technical feature, as they are not seen as directly linked with the stiffening function.

The spiral ribs section makes it possible to differentiate a container according to the invention from containers having a conventional configuration (e.g. with horizontal ribs).

At the same time, the alternating concave and convex structures turning around the bottle like a helix provide a strong side load improvement without giving the impression of a cheap or low-end bottle. Additionally, correctly designed spiral ribs do not significantly decrease the vertical deformation resistance (also called top-load deformation resistance) of the bottle, which is likely to be the case of horizontal ribs.

Providing a container with spiral ribs necessitates to make the right compromise between side-load deformation resistance and top-load deformation resistance, in particular with respect to a so-called "pop-out effect" which may occur in particular during transportation of the container (during transportation the container has to sustain high vertical compression loads).

To enhance grabbing or side-load deformation resistance, a high number of spiral ribs having a small length and high depth is advantageous. However, such a configuration promotes the pop-out effect: if the spiral ribs are deep and narrow, which is beneficial for grabbing resistance, the spiral rib elements will have the tendency to flip or fold from their initial concave geometry into a convex configuration resulting in a drastic reduction of the compression resistance of the container.

Therefore, there is an optimum compromise to find when a container is designed according to the invention, with spiral ribs, in particular when the depth, width, pitch and number of the ribs is chosen. This optimum is highly dependent on the capacity of the container, but cannot be expressed as, for example, a linear function of the parameters of the spiral ribs.

Although the invention has been described by way of example, it should be appreciated that variations and modifications will be apparent to those skilled in the art and may be made without departing from the scope of the invention as defined in the claims. Furthermore, where known equivalents exist to specific features, such equivalents are incorporated as if specifically referred in this specification.

The invention claimed is:

1. A container extending along a main axis and comprising a wall, the container comprising:

a neck portion, a shoulder portion connected to the neck portion, a body portion connected to the shoulder portion, the body portion comprising a grip portion, a base portion forming a bottom of the container and connected to the body portion, and the grip portion comprises, over at least a majority of a dimension along the main axis, a plurality of spiral ribs formed by the wall of the container and spiralling in parallel around the main axis;

wherein each spiral rib forms a concavity and a spiral tapered edge on an external surface of the wall, wherein, on a first flank of each spiral rib, the wall is smoothly deformed inwardly to form the concavity; wherein, on a second flank of each spiral rib, the wall abruptly joins the trajectory of the wall to form the spiral tapered edge, wherein the spiral tapered edge formed by the wall of the container is curved;

wherein each spiral rib further comprises a strip adjacent to the spiral tapered edge, the strip having a constant width and being defined in a surface of revolution having the main axis as revolution axis; and wherein the body portion further comprises a label portion between the shoulder portion and the grip portion and adapted to receive a flexible label, wherein a surface of the label portion is flat or comprises annular ribs.

2. The container according to claim 1, wherein the wall of the container forms an inflexion point at a bottom of the concavity, and wherein each spiral rib has a substantially constant width over a majority of a length of the spiral rib, the substantially constant width being measured between the inflexion point and the spiral tapered edge.

3. The container according to claim 2, wherein the substantially constant width is between 3 mm and 10 mm.

4. The container according to claim 1, wherein the constant width of the strip is comprised between 5 mm and 15 mm.

5. The container according to claim 1, comprising between three and seven spiral ribs.

6. The container according to claim 1, wherein each spiral rib forms an angle around the grip portion between 70° and 180° around the container.

7. The container according to claim 1, wherein each spiral rib has two ends, and wherein each spiral rib has a constant pitch or a variable pitch which changes along the spiral rib by decreasing from one end of the spiral rib to substantially the middle of the spiral rib and then by increasing to the other end of the spiral rib.

8. The container according to claim 1, wherein the grip portion has a non-circular cross section perpendicular to the main axis at least substantially in a middle of the grip portion.

9. The container according to claim 1, wherein the grip portion has, substantially in a middle of a dimension along the main axis, a shrunk cross section, and wherein an area of the shrunk cross section is between 25% and 75% of an area of a cross section of the container at a connection between the shoulder portion and the body portion.

10. The container according to claim 1, wherein each spiral rib has a maximum depth between 1 and 3.5 mm.

11. The container according to claim 10, wherein each spiral rib has a constant depth over at least a major part of a length of the spiral rib, the constant depth being the maximum depth.

12. The container according to claim 1, wherein the container has a total internal volume of between 15 cl and 150 cl.

13. The container according to claim 1, wherein a curvature radius of the spiral tapered edge is up to 2 mm.

14. The container according to claim 1, wherein a curvature radius of the spiral tapered edge is between 0.3 mm and 1.7 mm.

* * * * *